United States Patent [19]

Spann

[11] 4,418,514

[45] Dec. 6, 1983

[54] ORTHOPEDIC SUPPORT PACKAGE AND METHOD

[76] Inventor: Donald C. Spann, 1003 Botany Rd., Greenville, S.C. 29615

[21] Appl. No.: 314,181

[22] Filed: Oct. 23, 1981

Related U.S. Application Data

[63] Continuation of Ser. No. 194,359, Oct. 6, 1980, abandoned.

[51] Int. Cl.[3] ..... B65B 61/24

[52] U.S. Cl. ..... 53/436; 53/434; 53/438; 53/526

[58] Field of Search ..... 53/436, 438, 434, 432, 53/526, 527, 529, 512, 510, 115, 121

[56] References Cited

U.S. PATENT DOCUMENTS

| | | | |
|---|---|---|---|
| 1,557,881 | 10/1925 | Rogers | 53/436 X |
| 3,246,443 | 4/1966 | Slemmons | 53/436 |
| 3,458,966 | 8/1969 | Dunbar et al. | 53/436 X |
| 3,516,217 | 6/1970 | Gildersleeve | 53/436 X |
| 3,537,226 | 11/1970 | LeVan et al. | 53/434 X |
| 3,968,620 | 7/1976 | Keltner | 53/436 |

FOREIGN PATENT DOCUMENTS

| | | | |
|---|---|---|---|
| 1395509 | 3/1965 | France | 53/436 |

*Primary Examiner*—James F. Coan
*Attorney, Agent, or Firm*—Ralph Bailey

[57] ABSTRACT

A package for containing an orthopedic support constructed of open cell foam material may comprise a bag constructed of heat sealable thermoplastic multilayered film which is sealed along a single open edge after insertion of the orthopedic support therethrough into the bag. The orthopedic support is differentially compressed to such an extent as to reduce an irregular height dimension by a major amount with evacuation of a corresponding amount of air from the bag through the open edge prior to application of the heat seal along the open edge. An evacuated marginal portion of the bag extends outwardly about the orthopedic support by an amount corresponding to the reduction in height of the orthopedic support and results from the partial vacuum in the bag and the tendency of the open cell foam to rebound. The differential compression is obtained by using a press in compressing relationship with a press bed, applying compression to an extent which may be predetermined by utilizing a suitable stop means for limiting relative movement of the press members toward each other.

9 Claims, 12 Drawing Figures

Fig. 2.
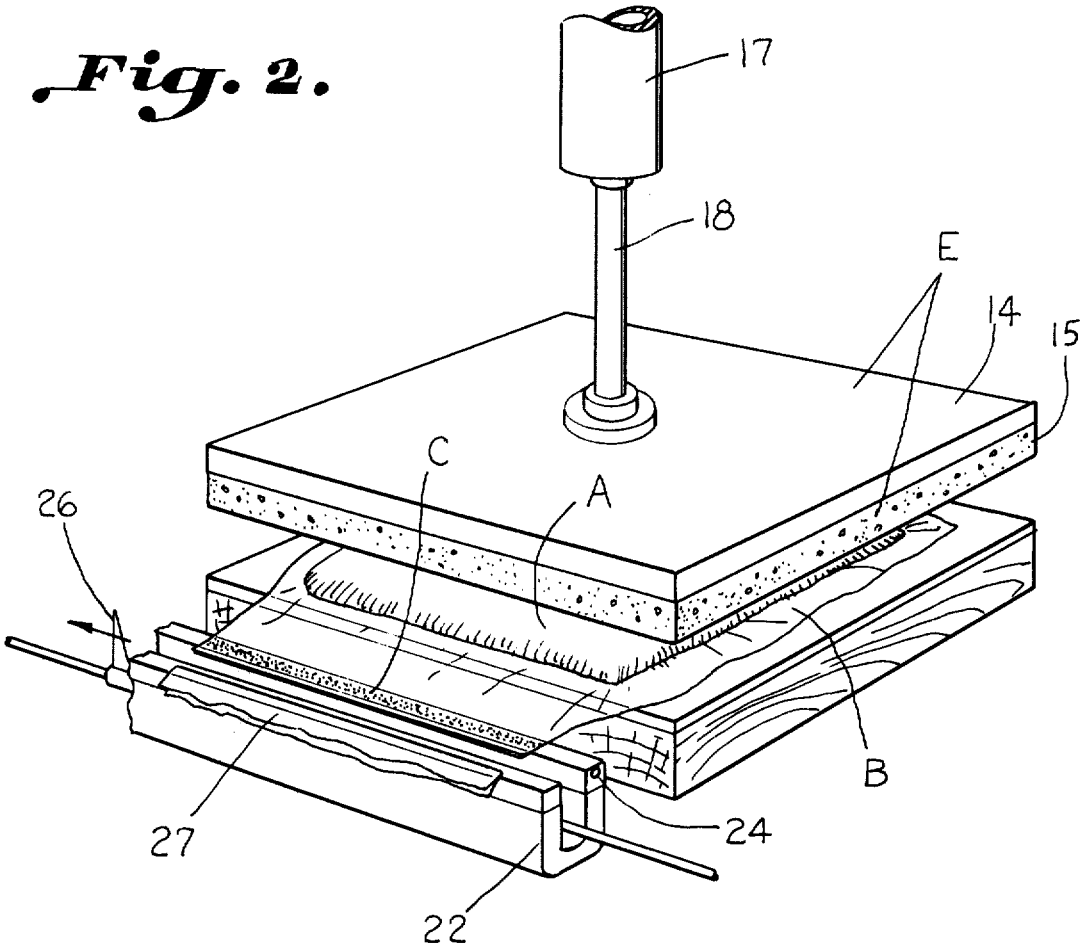
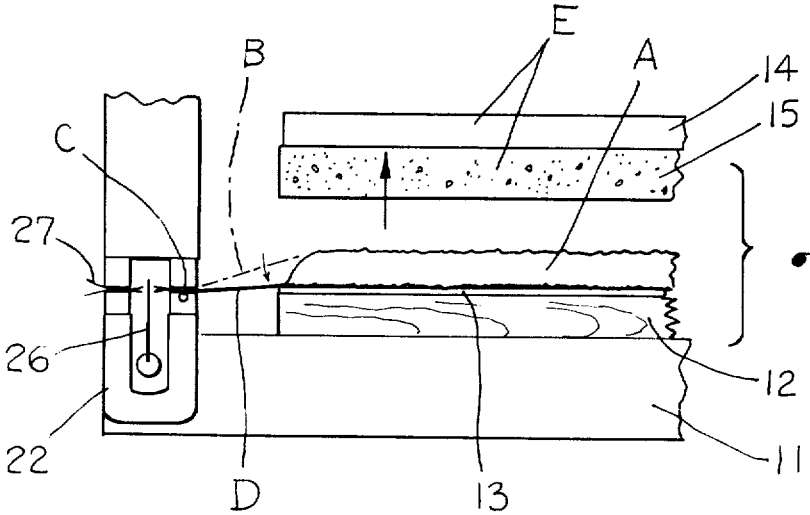
Fig. 3.

ORTHOPEDIC SUPPORT PACKAGE AND METHOD

This is a continuation of application Ser. No. 194,359, filed Oct. 6, 1980, and now abandoned.

BACKGROUND OF THE INVENTION

Storage is a major problem in connection with supplying foam orthopedic supports for patients of hospitals and other healthcare facilities due to the bulky nature of such supports. It is difficult to carry the foam supports, for example, upon the already crowded carts which are utilized by nurses and other attendants to supply patients with medication and other needs. It has even been found that patients who would be best treated with foam orthopedic supports are denied their use because of the difficulties in supplying them to the patients.

The most commonly used method of packaging the foam orthopedic supports which have been in use heretofore is through the use of heat shrinkable thermoplastic material. While such material affords an attractive sanitary package, there is little or no reduction in bulk. The prior art relating to the packaging of foam cushions includes U.S. Pat. No. 3,246,443, but this patent contemplates the use of individual sheets between which the regular shaped foam cushion is sandwiched. The regular shaped foam cushion with the thermoplastic sheets above and below on either side is compressed between press members acting as a bed and a platen. The difficulty is that a seal is required on all sides of the package, and while a uniformly aligned smoothly sealed package is illustrated in the patent, it has been found that from a practical standpoint in commercial packaging involving substantial numbers, such a package is difficult to achieve. Further efforts include those exemplified by U.S. Pat. No. 3,968,620 wherein an air suction apparatus is used to evacuate the air from a package containing regularly shaped compressible material. This suction system is perhaps the most apparent solution to the problem, but the degree of compression or reduction in size of the foam article is not sufficient to achieve the desired results when supplying orthopedic foam supports.

Accordingly, it is an important object of the present invention to supply an orthopedic support package wherein the foam orthopedic support may be reduced in volume to such an extent as to make its storage and presence for use by a patient readily available.

Another important object of the present invention is to provide a sanitary means of packaging an orthopedic support which will provide a longer storage shelf life together with convenience in dispensing for supplying in healthcare facilities to orthopedic patients.

Another important object of the invention is to provide a method of forming a package for reducing the size of the orthopedic supports which may be relatively inexpensive and practical from the standpoint of providing reduced storage and space requirements to facilitate the supplying of orthopedic supports of the foam type to orthopedic patients.

SUMMARY OF THE INVENTION

It has been found that satisfactory orthopedic packages of reduced size may be obtained by utilizing a multi-layered thermoplastic bag which is sealed except for a single opening to accommodate reception of the orthopedic support within the bag. The orthopedic support is placed within the bag which is then pressed within a suitable compression applying means such as a press having members acting as a platen and as a bed. After compression has been applied so as to differentially compress the height dimensions of the irregularly shaped orthopedic support, and evacuating air from the bag, the sealing along the single open edge may be accomplished conveniently, and the marginal portions in that area trimmed away as by cutting. When the compressive action of the press is removed, an evacuated flat marginal portion of the bag extends outwardly entirely about the orthopedic support by an amount resulting from the reduction in height of the support due to the vacuum in the sealed bag and the tendency of the foam article to expand.

It is desirable but not necessary, that some mechanical means be employed for precompressing the foam article so that relatively small bags may be utilized thus conserving on the thermoplastic bag material and permitting a less costly process. This precompression may be obtained, for example, by forcing the foam article between constricting members which hold the bag on the outside thereof to facilitate reception through the open end of the bag of the precompressed orthopedic support.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 2 is an enlarged perspective view broadly illustrating the press and orthopedic support package of FIG. 1, FIG. 3 is a still further enlarged sectional elevation through an edge portion of the press and support package utilized in FIG. 1.

DESCRIPTION OF A PREFERRED EMBODIMENT

The drawings illustrate an orthopedic support A constructed of resilient synthetic open cell foam material having a substantial, albeit irregular height dimension with air entrained therein. A bag B is constructed of heat sealable thermoplastic multi-layered film sealed along its edges except for a single open edge portion thereof for insertion of said orthopedic support. The orthopedic support is differentially compressed to such an extent as to reduce a dimension thereof by a major amount with evacuation of a corresponding amount of air from the bag. A heat seal C is placed along the single open edge portion placed therein after the compression and evacuation. An evacuated marginal portion D of the bag extends outwardly about the orthopedic support by an amount resulting from the reduction in height of the orthopedic support. Thus, the package may be conveniently stored and the orthopedic support dispensed therefrom by a healthcare facility by releasing same from said bag permitting return of the orthopedic support substantially to its original full unrestrained size when needed for use by an orthopedic patient. The differential compression described above is obtained by urging a cushioned platen E of a press into compressing relationship with a smooth bed of the press to an extent which may be determined as by a suitable mechanical stop. The package is temporarily stored to test for leaks and is then shipped to the customer.

Figure 1:
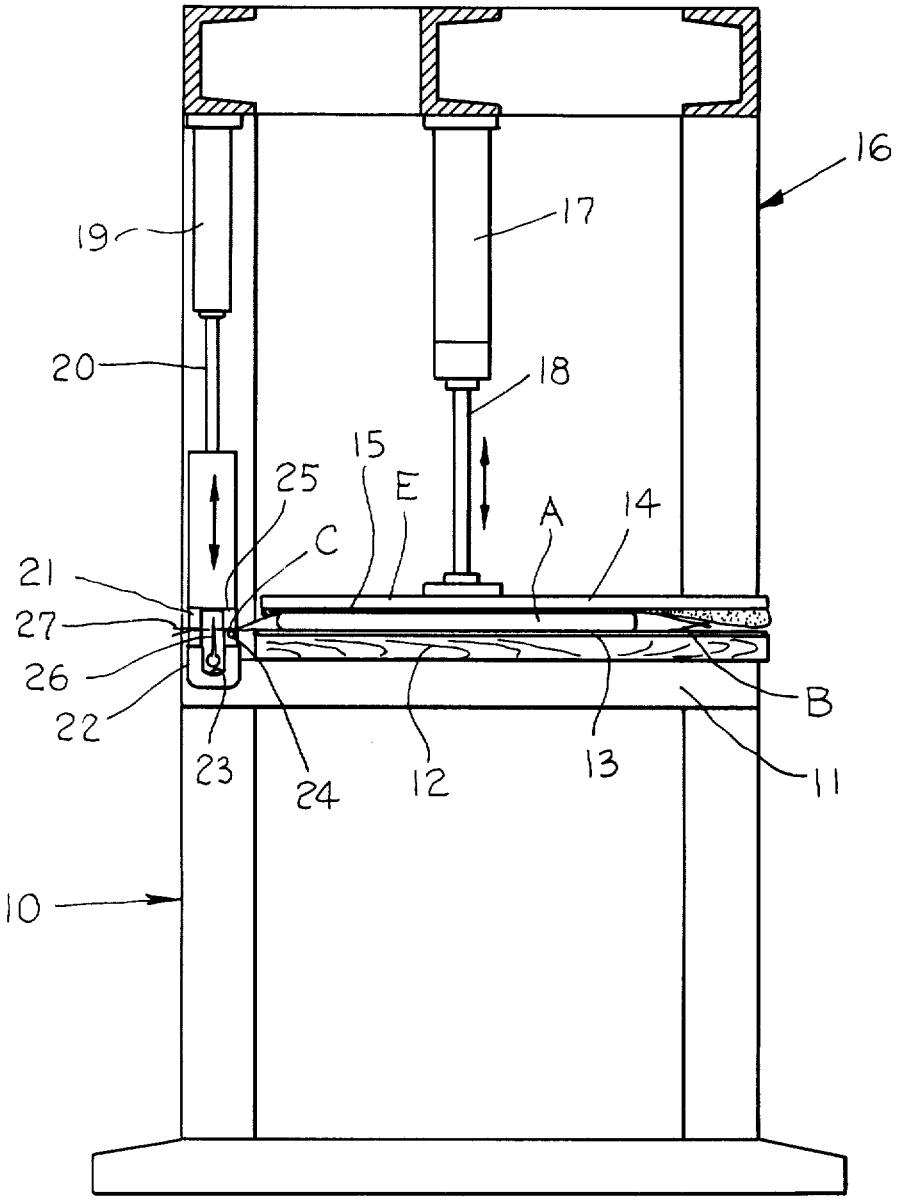
FIG. 1 is a sectional side elevation illustrating a suitable press and orthopedic support package in process of being formed therein in accordance with the invention.

FIG. 1 illustrates a press which includes a lower frame member broadly designated at 10 for carrying a bed which includes a lower portion 1 which may carry built up wooden member 12 for accommodating a smooth planer plastic surface. The platen E is illustrated as including a rigid member 14 having compressible portions 15 which may be constructed as from foam.

The press includes an upper frame, broadly designated at 16 which supports a fluid operated cylinder 17 which, through the rod 18 operates the platen E. Suitable mechanical stop means are employed for limiting the downward movement of the press platen member, but these stops are conventional and are not shown except insofar as they may include portions of the sealing means which come together and which are described below.

A second hydraulic or air operated cylinder 19 has a piston rod 20 for lowering a front gripping member 21 which bears against a first portion 22 of a U-shaped member which defines an opening 23 therein. The U-shaped member 22 at its back leg carries a wire or other suitable heating element 24 which engages a back member 25 opposite the member 21 for effecting a heat seal C. The heat sealing operation occurs immediately following compression by the lowering of the platen E by actuation of the cylinder 17 by lowering of the members 21 and 25 by operation of the cylinder 19 which follows evacuation. Together with the sealing operation A, a transversely movable knife 26 is provided for trimming off an edge 27 of the bag, primarily for esthetic reasons, but also to provide a uniform package edge. Knives of the type illustrated at 26 are common expedients in various sealing operations.

By reference to FIG. 2, it will be noted that, after the sealing operation forming the seal C, the knife 26 moves transversely in the direction of the arrow to trim off the edge 27. It will be further noted that during and prior to compression, the edges of the bag are expanded or substantially V-shaped, but by reference to FIG. 3, it will be noted that after removal of the compression by raising the platen E, that the edge portions of the bag are sucked together because of the vacuum obtained within the package and because of expansion of the foam member A after removal of the compression. The edges B thus formed are significant in that they may be punctured by an attendant which permits full expansion of the orthopedic support within the bag prior to tearing away the bag for use. Thus, a limited sanitary storage is expanded condition is possible and if this is not desired, the bag may be easily removed at once without damage to the orthopedic support.

It has been found that it is possible to reduce the height dimension of the open cell type polyurethane foam materials which are often used in orthopedic supports by an amount in excess of about 80%, or to approximately a 6 to 1 reduction of the unrestricted height of the orthopedic support. Such foam material has a density on the order of about 1.63 pounds per cubic foot, and an indentation load deflection of about 34 to 38. It is important that the material of the thermpolastic bag be capable of being heat sealed and that it have sufficient shelf life to prevent leaking and seepage of air for affording a suitable shelf life. Such material has been found to be of a multi-layered thermoplastic film material such as designated as B-620 bag supplied by Cryovac. This multi-layer sealing bag is designed specifically for vacuum packaging of fresh meat, but it has been found that this bag may serve the purpose of containing the orthopedic support as described herein. It is not believed at present that the heat shrinkable material often employed in wrapping meat would be suitable for the purposes discussed herein.

Figure 5:
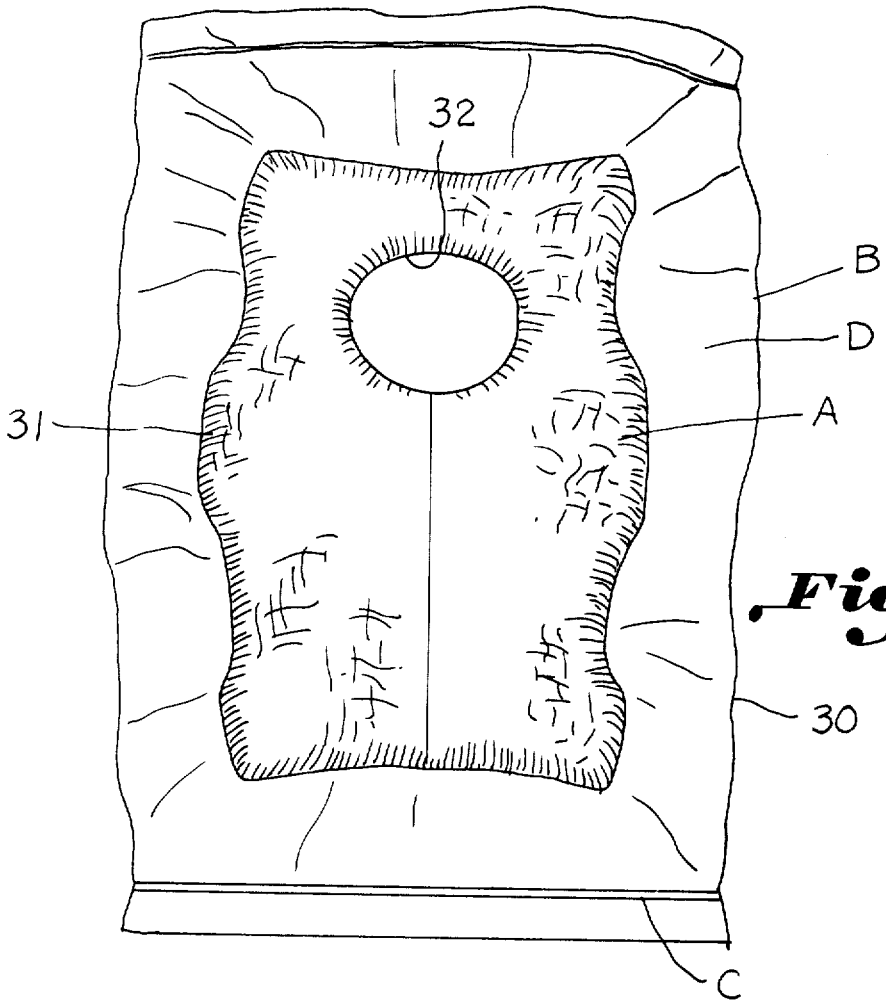
FIG. 5 is a plan view of a support package formed from the article illustrated in FIG. 4.
Figure 4:
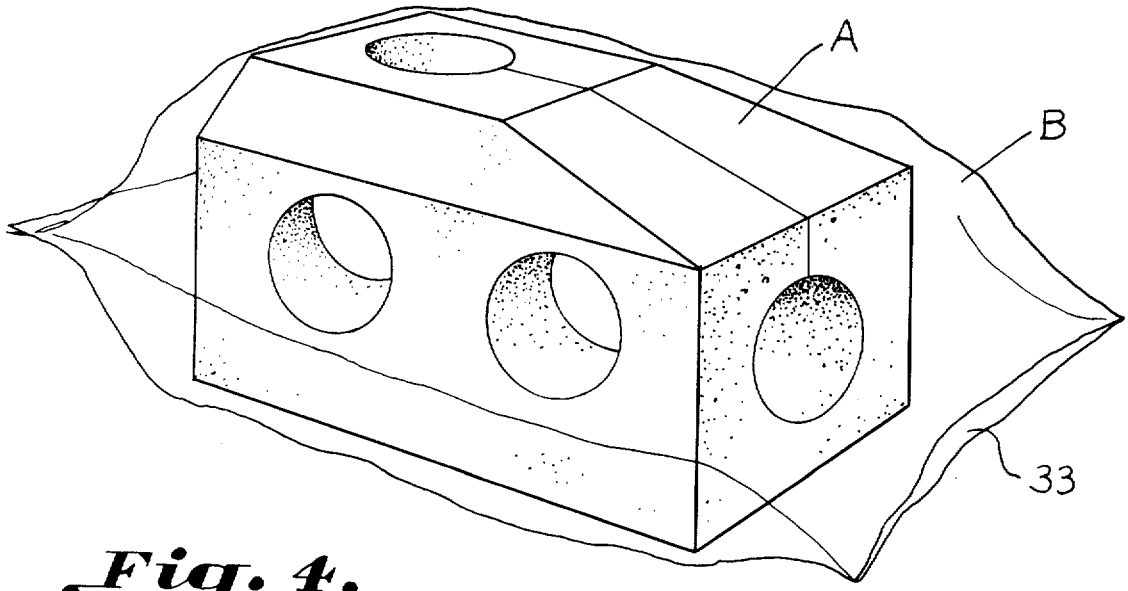
FIG. 4 is a perspective view of an orthopedic support package in the form of a cradle boot within a thermoplastic bag prior to compression.

By way of example, various specific foam orthopedic support articles and their packages constructed in accordance with the invention are illustrated. The cradle boot illustrated in FIGS. 4 and 5 is more fully described in U.S. Pat. No. 4,135,504. It will be observed that the presealed edges as illustrated at 30 are somewhat irregular after packaging and sealing, while the seal C is fairly regular in its alignment. The article contained within the marginal portions which extend thereabout and which contain collapsible portions of the bag serve to retain the orthopedic support in compressed relation. The height dimension is reduced while the general outline remains fairly uniform except that the thickened portions of the article extend outwardly as illustrated at 31. The vertical opening is somewhat elongated as illustrated at 32. The article is inserted as through an open end of the bag illustrated at 33. The height reduction of the cradle boot, for example, is approximately 83%. In other words, the maximum nine inch dimension is reduced to approximately 1 and ½ inches.

Figure 7:
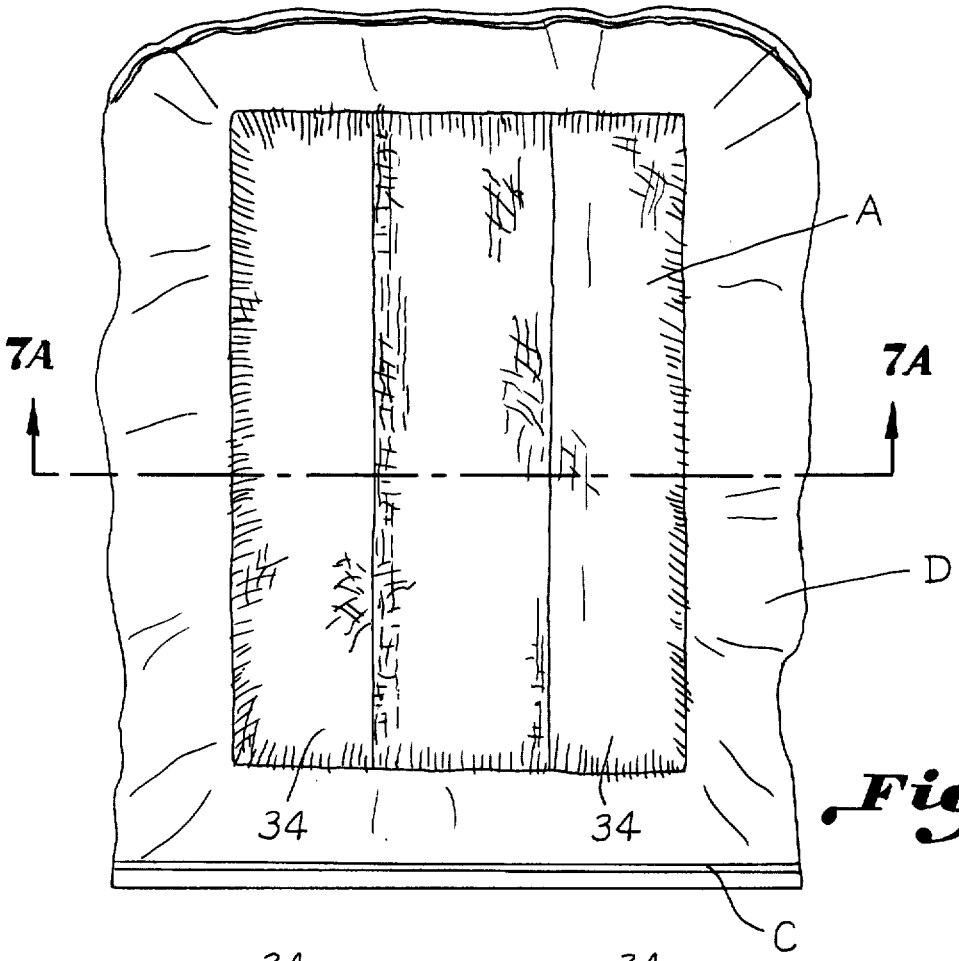
FIG. 7 is a plan view illustrating the support package formed after compression of the article illustrated in FIG. 6.
Figure 7A:
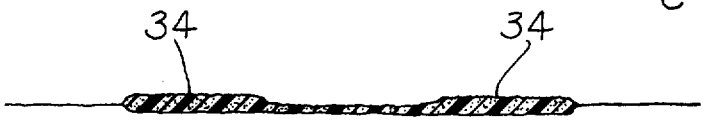
FIG. 7A is an end view of the package illustrated in FIG. 7.
Figure 6:
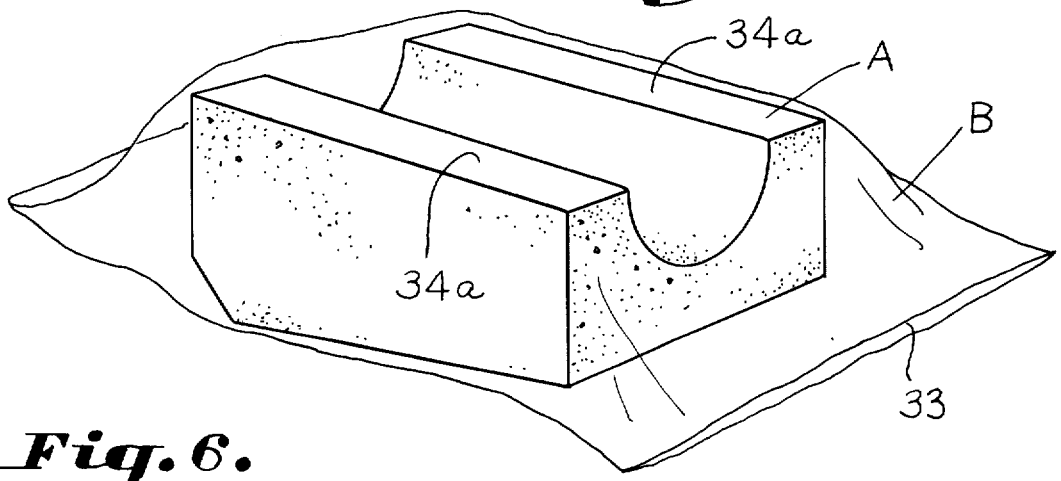
FIG. 6 is a perspective view of an orthopedic support in the form of a cast elevator and the like contained within a thermoplastic bag prior to compression.

FIGS. 6 and 7 illustrate the packaging of a cast elevator which is of the type more fully illustrated in U.S. Pat. No. 3,946,451. The open end of the bag is illustrated at 33 and the thickened portions of the article may be observed as at 34 in FIGS. 7 and 7A. These raised portions 34 which are barely perceptible after the height dimension has been differentially reduced, correspond to the raised side portions **34*a* in FIG. 6**.

Figure 9:
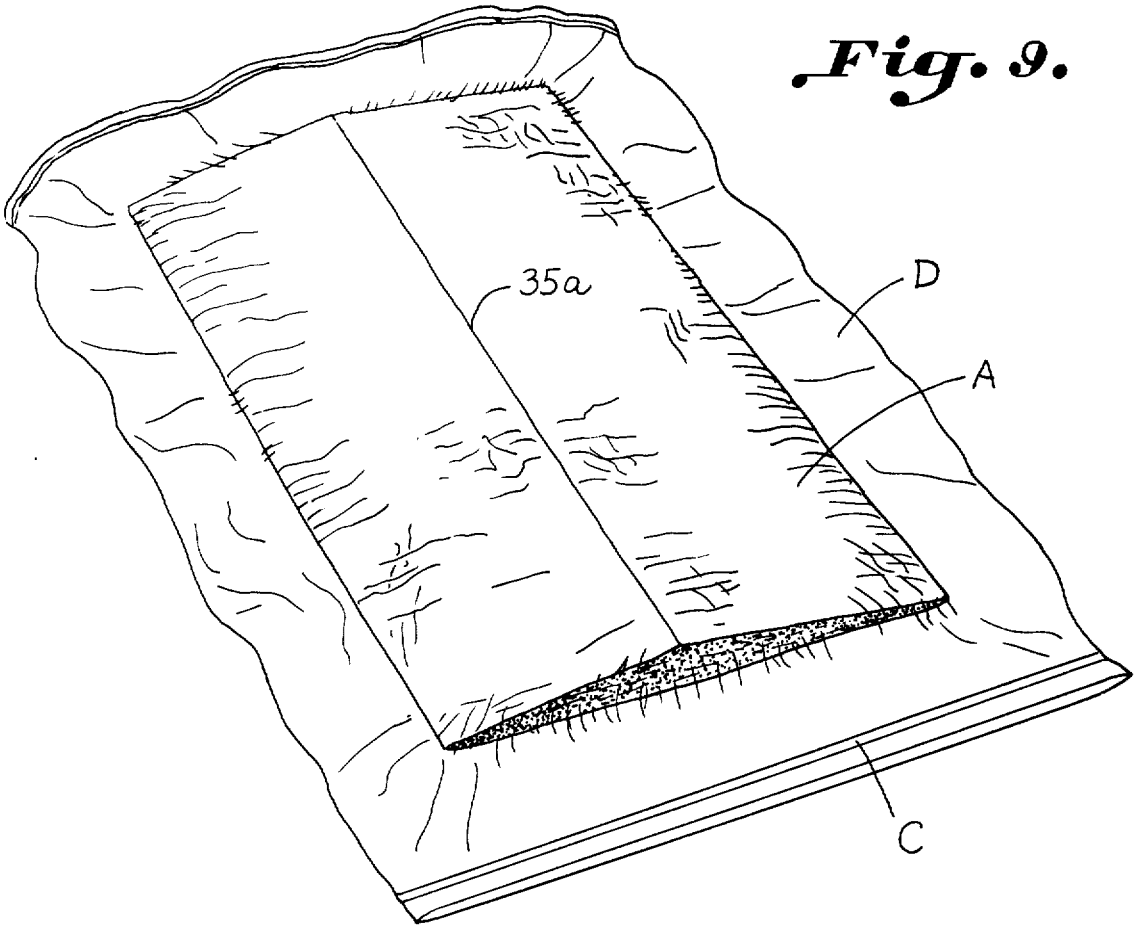
FIG. 9 is an enlarged perspective view illustrating the package comprising the body aligner illustrated in FIG. 8.
Figure 8:
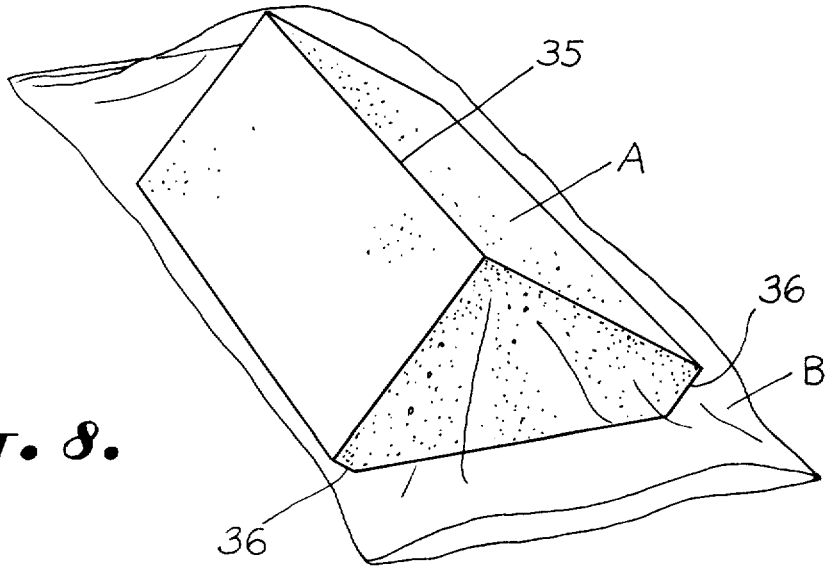
FIG. 8 is a perspective view illustrating a body aligner carried within a thermoplastic bag prior to compression.

FIGS. 8 and 9 illustrate the packaging of a body aligner of the type more fully illustrated in U.S. Pat. No. 3,938,205. The body aligner has its major height dimension culminating in the apex portion illustrated at 35.

Figure 11:
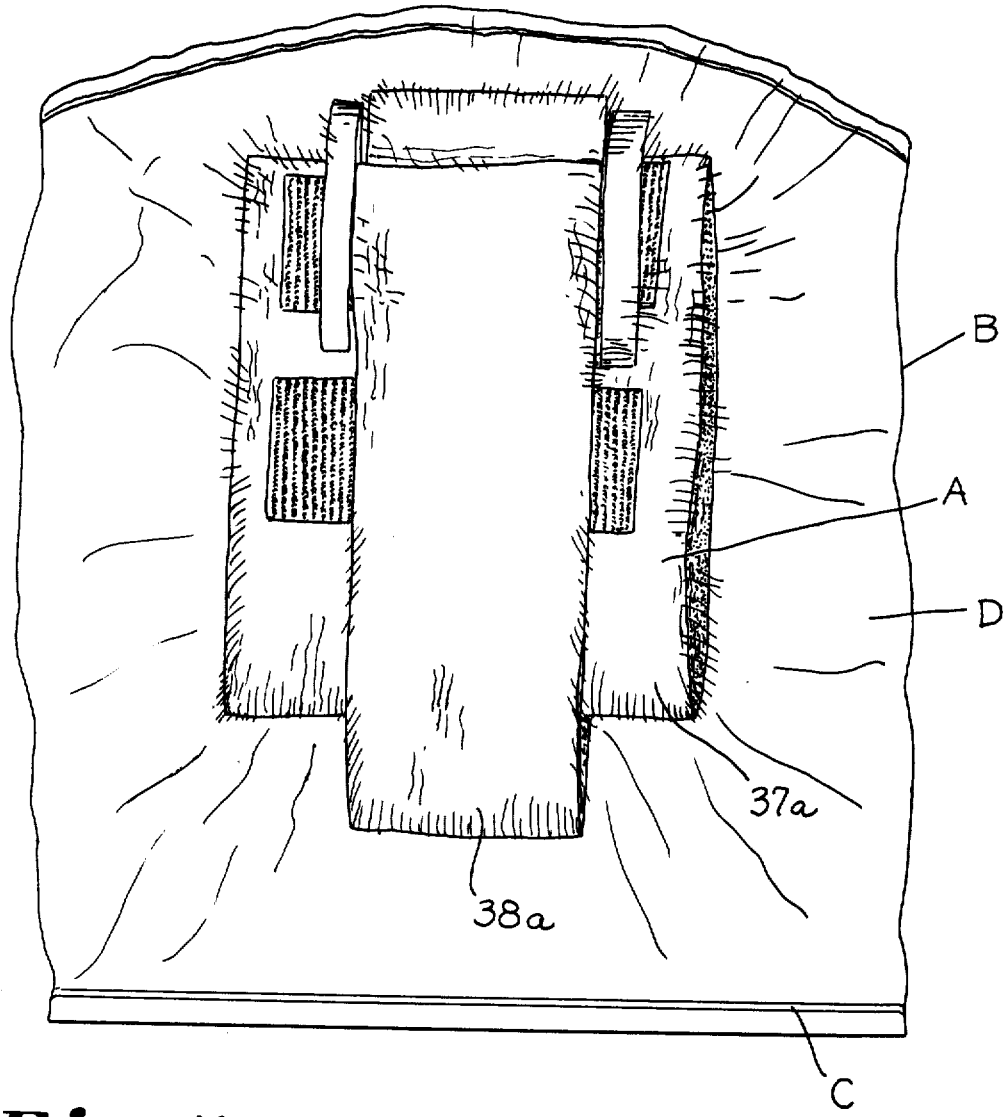
FIG. 11 is an enlarged plan view illustrating a package containing the article.
Figure 10:
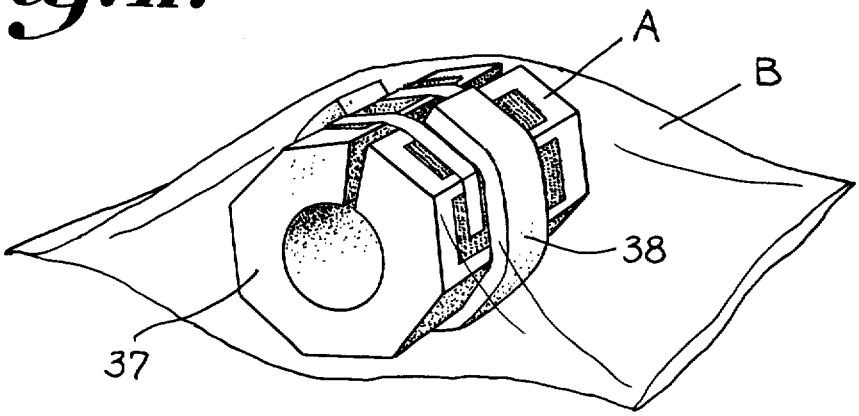
FIG. 10 is a perspective view illustrating a foot drop support and the like contained within a thermoplastic heat sealable bag prior to compression and sealing.

The apex portion is barely perceptible being illustrated at 35*a* in FIG. 9. The irregular edge portions as illustrated at 36, do not reveal themselves to any perceptible extent in the final package illustrated in FIG. 9. The packaging of a foot drop support is illustrated in FIGS. 10 and 11 wherein the cuff portion 37 is illustrated in compressed form as at 37*a* in FIG. 11, carrying thereabout a strap 38 illustrated in compressed form as at 38*a* in FIG. 11. The foot drop support is more fully illustrated in U.S. Pat. No. 3,903,878. While specific orthopedic supports are illustrated for illustrative purposes, any open cell foam orthopedic support may be thus packaged.

It is important that, after packaging, the foam orthopedic supports be stored for about a day or two to determine whether or not there is any leakage. If there is any substantial expansion of the package during this period, the supports are returned for repackaging prior to shipment and use by the customer. It is also significant that while the step of differentially compressing the orthopedic supports is taking place, that a yieldable substantially uniform force is applied on one side of the orthopedic support by the planer foam bed illustrated upon the platen against the smooth surface on the other side of the orthopedic support which is furnished by the substantially rigid wooden planar surface beneath the smooth plastic sheet. Such an application of force avoids leakage through partial or complete puncturing of the plastic bag. The yieldable member may be carried by the bed and the smooth sheet by the platen if preferred.

While a preferred embodiment of the invention has been described using specific terms, such description is for illustrative purposes only and it is to be understood that changes and variations may be made without departing from the spirit or scope of the following claims.

What is claimed is:

1. The method of packaging an orthopedic support comprising:

providing an orthopedic support constructed essentially of resilient synthetic open cell foam material with air entrained therein having a substantial and irregular height profile and a highly bulky configuration;

providing a thermoplastic bag constructed of heat sealable thermoplastic film having a sufficient shelf life to prevent leaking and seeping of air affording storage of said package in a healthcare facility for extended periods of time, said bag having presealed edges but providing an open edge portion thereof for insertion of said orthopedic support therethrough;

compressing said orthopedic support minimizing the bag size required;

placing said orthopedic support thus compressed within said bag;

differentially compressing said orthopedic support within said bag to such an extent as to reduce said substantial profile and bulk configuration by a major amount to a generally uniform flat configuration with evacuation of a corresponding amount of air from said bag by urging a platen of a press into compressing relation with a bed of the press by a predetermined amount;

placing a heat seal along said open edge portion after said compression and evacuation; and releasing the compressing action of said press after heat sealing said edge portion.

2. The method of packaging and dispensing an orthopedic support comprising:

providing an orthopedic support constructed essentially of resilient synthetic open cell foam material with air entrained therein having a substantial and irregular height profile and a highly bulky configuration;

providing a thermoplastic bag constructed of heat sealable thermoplastic multi-layered film having a sufficient shelf life to prevent leaking and seeping of air affording storage of said package in a healthcare facility for extended periods of time, said bag having presealed edges but providing an open edge portion thereof for insertion of said orthopedic support therethrough;

placing said orthopedic support within said bag;

differentially compressing said orthopedic support within said bag to such an extent as to reduce said substantial profile and bulk configuration by a major amount to a generally uniform flat configuration with evacuation of a corresponding amount of air from said bag by urging a platen of a press into compressing relation with a bed of the press by a predetermined amount;

placing a heat seal along said single open edge portion after said compression and evacuation; and releasing the compressing action of said press after heat sealing said edge portion resulting in the formation of an evacuated marginal portion of said bag extending outwardly about said orthopedic support by an amount corresponding generally to the reduction is height of said orthopedic support forming a package;

whereby said package may be stored by a healthcare facility in said compressed generally uniform flat configuration until such time as utilized by an orthopedic patient at said facility and dispensed at said time of utilization by releasing compression in said bag and said orthopedic support compressed therein permitting return of said orthopedic support substantially to its original full unrestrained profile and configuration when needed for use by an orthopedic patient.

3. The method set forth in claim 2, including storing said package temporarily to check for leakage of the bag, and then supplying said package for storage by said healthcare facility.

4. The method of packaging and dispensing an orthopedic support comprising:

providing an orthopedic support constructed essentially of resilient synthetic open cell foam material with air entrained therein having a substantial and irregular height profile and a highly bulky configuration;

providing a thermoplastic bag constructed of heat sealable thermoplastic multi-layered film having a sufficient shelf life to prevent leaking and seeping of air affording storage of said package in a healthcare facility for extended periods of time, said bag being presealed along its edges but providing an open edge portion thereof for insertion of said orthopedic support therethrough;

placing said orthopedic support within said bag;

differentially compressing said orthopedic support within said bag to such an extent as to reduce said substantial profile and bulk configuration by a major amount to a generally uniform flat configuration with evacuation of a corresponding amount of air from said bag by utilizing fluid pressure to urge a platen of a press into compressing relation with a bed of the press by a predetermined amount;

placing a heat seal along said single open edge portion after said compression and evacuation;

releasing the compressing action of said press after heat sealing said edge portion resulting in the formation of an evacuated marginal portion of said bag extending outwardly about said orthopedic support by an amount corresponding to the reduction in height of said orthopedic support forming a package;

storing said package by a healthcare facility in said compressed generally uniform flat configuration until such time as utilized by an orthopedic patient at said facility; and dispensing said product at said time of utilization by releasing compression in said bag and said orthopedic support compressed therein permitting return of said orthopedic support substantially to its original full unrestrained profile and configuration when needed for use by an orthopedic patient.

5. The method set forth in claim 4, wherein the step of differentially compressing is continued until the height is reduced by an amount in excess of about 80%.

6. The method set forth in claim 4, wherein said step of differentially compressing said orthopedic support includes applying a yieldable substantially uniform force on one side of said orthopedic support against a smooth surface on the other side of said orthopedic support.

7. The method set forth in claim 4, including storing said package temporarily to check for leakage of the bag, and then supplying said package for storage by said healthcare facility.

8. The method of claim 4 including compressing said orthopedic support prior to placing said support within said bag further minimizing the bag size required and final package size.

9. The method of packaging an orthopedic support facilitating storage and dispensing of the orthopedic support comprising:

providing an orthopedic support constructed essentially of resilient synthetic open cell foam material with air entrained therein having a substantial and irregular height profile and a highly bulky configuration;

providing a thermoplastic bag constructed of heat sealable thermoplastic multi-layered film having a sufficient shelf life to prevent leaking and seeping of air affording storage of said package in a healthcare facility for extended periods of time, said bag having presealed edges but providing an open edge portion thereof for insertion of said orthopedic support therethrough;

placing said orthopedic support within said bag;

differentially compressing said orthopedic support within said bag to such an extent as to reduce said substantial profile and bulk configuration of a major amount to a generally uniform flat configuration of irregular outline with evacuation of a corresponding amount of air from said bag by urging a platen of a press into compressing relation with a bed of the press by a predetermined amount;

placing a heat seal along said open edge portion after said compression and evacuation but while maintaining said platen in said compressing relation;

forming an evacuated marginal portion of said bag extending outwardly entirely about said orthopedic support by an amount corresponding to the reduction in height of said orthopedic support by partial expansion of the foam material caused by releasing the compressing action of said press after heat sealing said edge portion forming a package;

whereby said package may be stored by a healthcare facility in said compressed generally uniform flat configuration until such time as utilized by an orthopedic patient at said facility; and whereby said product may be dispensed at said time of utilization by releasing compression in said bag and said orthopedic support compressed therein permitting return of said orthopedic support substantially to its original full unrestrained profile and configuration when needed for use by an orthopedic patient.

* * * * *